US010143286B2

(12) United States Patent
Rafaeli et al.

(10) Patent No.: US 10,143,286 B2
(45) Date of Patent: Dec. 4, 2018

(54) HAIR SHAVING APPARATUS WITH ADJUSTABLE HEAD ANGLE

(71) Applicant: Radiancy Inc., Orangeburg, NY (US)

(72) Inventors: Dolev Rafaeli, Creskill, NJ (US); Philip Solomon, Kibbutz Tzora (IL)

(73) Assignee: ICTV Brands, Inc., Wayne, NJ (US)

( * ) Notice: Subject to any disclaimer, the term of this patent is extended or adjusted under 35 U.S.C. 154(b) by 176 days.

(21) Appl. No.: 15/021,696

(22) PCT Filed: Aug. 20, 2014

(86) PCT No.: PCT/US2014/051774

§ 371 (c)(1),
(2) Date: Mar. 13, 2016

(87) PCT Pub. No.: WO2015/038298

PCT Pub. Date: Mar. 19, 2015

(65) Prior Publication Data

US 2016/0242526 A1 Aug. 25, 2016

Related U.S. Application Data

(60) Provisional application No. 61/877,990, filed on Sep. 15, 2013.

(51) Int. Cl.
*A45D 26/00* (2006.01)
*B26B 21/48* (2006.01)

(52) U.S. Cl.
CPC ..... *A45D 26/0009* (2013.01); *A45D 26/00* (2013.01); *B26B 21/48* (2013.01)

(58) Field of Classification Search
CPC .... Y10T 83/04; A45D 26/0009; A45D 26/00; A61B 18/14; A61B 18/04; A61B 18/144;
(Continued)

(56) References Cited

U.S. PATENT DOCUMENTS 4,378,633 A * 4/1983 Jacobson ..... B26B 21/227 30/47
5,933,960 A * 8/1999 Avidor ..... B26B 19/30 30/34.2

(Continued)

FOREIGN PATENT DOCUMENTS

WO 2010136943 A1 12/2010
WO 2013011505 A1 1/2013

OTHER PUBLICATIONS

International Search Report for parent PCT application PCT/US2014/051774, issued by European Patent Office dated Oct. 31, 2014.

(Continued)

*Primary Examiner* — Phong Nguyen
(74) *Attorney, Agent, or Firm* — Simon Kahn; Chanoch Kahn

(57) ABSTRACT

A hair shaving apparatus constituted of: a heating element arranged to be heated to a temperature sufficient to cut hair proceeding from a skin surface; a shaving head exhibiting a pair of opposing walls, the heating element positioned in between the opposing walls and juxtaposed to an opening plane defined by an end of each of the opposing walls; and a handle coupled to the shaving head and exhibiting a longitudinal axis arranged to present a device angle with the skin surface, wherein the opening plane is arranged to be rotated about a first and a second rotation axis, generally orthogonal to each other and generally parallel to the opening plane, the rotation about the first and second rotation axis maintains a generally parallel relationship between the opening plane and the skin surface when the device angle changes.

12 Claims, 7 Drawing Sheets

(58) Field of Classification Search
CPC ..... B26B 21/40; B26B 21/00; B26B 21/405; B26B 21/4056; B26B 21/48; B26B 21/52; B26B 21/526
USPC ..... 219/222, 223; 606/36, 43, 133; 30/32, 30/34.05, 140, 34.2, 526, 529
See application file for complete search history.

(56) References Cited

U.S. PATENT DOCUMENTS 8,819,946 B2 * 9/2014 Yamasaki ..... B26B 19/048 30/32
9,676,108 B2 * 6/2017 Beugels ..... B26B 19/048
9,839,475 B2 * 12/2017 Solomon ..... A61B 18/18

OTHER PUBLICATIONS

Written Opinion for International Search Report for parent PCT application PCT/US2014/051774, issued by European Patent Office dated Oct. 31, 2014.
International Search Report for PCT/US2014/051774 dated Oct. 9, 2014 by European Patent Office.
Written Opinion of the International Searching Authority for PCT/US2014/051774 dated Oct. 9, 2014 by European Patent Office.
Office Action dated Feb. 24, 2018 by the Chinese Patent Office for Application 201480050593.0.

* cited by examiner

HAIR SHAVING APPARATUS WITH ADJUSTABLE HEAD ANGLE

TECHNICAL FIELD

The present invention relates generally to the field of hair shavers and more particularly to a hair shaver with an adjustable head angle.

BACKGROUND

The removal of unwanted hair growth from the body can be accomplished with mechanized means, for example razors, tweezers or wax, all of which are uncomfortable to use, irritate the skin and/or cause damage to the skin. Another form of hair removal is by heating the hair growth to a temperature sufficient to cut the hair, however a concern of devices for hair removal involving heat is the danger of skin damage from excess heat. U.S. Pat. No. 6,825,445, issued Nov. 30, 2004 to Shalev et al., the entire contents of which is incorporated herein by reference, is addressed to an electric shaver comprising a heat generator and one or more heat elements heated to a temperature sufficient to cut hair, the heat generator arranged to prevent heat from being applied continuously in a single area for sufficient time to cause skin damage.

U.S. Pat. No. 7,170,034, issued Jan. 30, 2007 to Shalev et al., the entire contents of which is incorporated herein by reference, is addressed to an electric shaver comprising a heat element heated to a temperature sufficient to cut hair, the heating of the heat element being pulsed to prevent heat from being applied continuously in a single area for sufficient time to cause skin damage.

U.S. Pat. No. 7,202,446, issued Apr. 10, 2007 to Shalev et al., the entire contents of which is incorporated herein by reference, is addressed to an electric shaver comprising an elongate heating element heated to a temperature capable of cutting hair and a vibrating structure on which the elongate heating element is mounted, the vibrating structure arranged to prevent skin damage.

U.S. Pat. No. 8,367,974, issued Feb. 5, 2013 to Azar, et al, the entire contents of which is incorporated herein by reference, is addressed to a hair cutting device comprising a detector adapted to detect motion of the shaver heated wire arranged to cut hair, a hair cutting removal and suppression head having a heated wire suitable for heating hair growing from the skin and cutting the hair, and a controller arranged to move the hair cutting removal and suppression head between a hair cutting position and a retracted position responsive to the presence of, or absence of, detected motion.

Unfortunately, in all of the above described shavers the shaver must be held at a 90 degree angle in relation to the skin in order to effectively cut the skin. However, holding the shaver at the correct angle is difficult, especially when moving the shaver over body parts which are not straight. It would thus be preferable to provide such a shaver with the ability to effectively cut hair even when not held at a 90 degree angle in relation to the skin.

SUMMARY

Accordingly, it is a principal object to overcome at least some of the disadvantages of prior art. This is accomplished in certain embodiments by providing a hair shaving apparatus constituted of: a heating element arranged to be heated to a temperature sufficient to cut hair proceeding from a skin surface; a shaving head exhibiting a pair of opposing walls, the heating element positioned in between the opposing walls and juxtaposed to an opening plane defined by an end of each of the opposing walls; and a handle coupled to the shaving head and exhibiting a longitudinal axis arranged to present a device angle with the skin surface. The opening plane is arranged to be rotated about a first rotation axis and a second rotation axis, the first rotation axis and the second rotation axis generally orthogonal to each other and generally parallel to the opening plane. The rotation about the first rotation axis and the second rotation axis maintains a generally parallel relationship between the opening plane and the skin surface regardless of a change in the device angle.

The embodiments herein independently enable a hair shaving apparatus comprising: a power source; a heating element, the heating element arranged to be heated to a temperature sufficient to cut hair proceeding from a skin surface, the heating element heated with electric power from the power source; a shaving head exhibiting a pair of opposing walls, the heating element positioned in between the opposing walls and juxtaposed to an opening plane defined by an end of each of the opposing walls, the opening plane arranged to be generally parallel to the skin surface; and a handle, the handle coupled to the shaving head and exhibiting a longitudinal axis, the longitudinal axis arranged to present a device angle between the longitudinal axis and the skin surface, wherein the opening plane is arranged to be rotated about a first rotation axis and a second rotation axis, the first rotation axis and the second rotation axis generally orthogonal to each other and generally parallel to the opening plane, the rotation about the first rotation axis and the second rotation axis maintains the generally parallel relationship between the opening plane and the skin surface when the device angle changes.

In one further embodiment, the hair shaving apparatus further comprises a shaving head rotational base, the shaving head rotational base coupled to the handle and to the shaving head, wherein the arrangement of the opening plane to be rotated about the second rotation axis comprises a rotation of the shaving head rotational base about the second rotation axis. In one yet further embodiment the shaving head comprises a shaving head extender, the shaving head rotational base comprises a base rotation extender and a head rotation guide, and the handle comprises a base rotation guide, wherein the rotation about the first rotation axis comprises sliding the shaving head extender along the head rotation guide, and wherein the rotation about the second rotation axis comprises sliding the base rotation extender along the base rotation guide.

In one further embodiment the shaving head is arranged to be rotated about the first rotation axis by about 30 degrees. In another further embodiment the shaving head is arranged to be rotated about the second rotation axis by about 30 degrees.

In one further embodiment the shaving head comprises a pair of rollers, each coupled to an end of a respective one of the opposing walls, the pair of rollers defining the opening plane and arranged to be in contact with the skin surface, and wherein the maintenance of the generally parallel relationship between the opening plane and the skin surface comprises maintaining both of the rollers in contact with the skin surface. In another further embodiment the hair shaving apparatus further comprises: a control circuitry; and a motion sensor in communication with the control circuitry and arranged to detect motion of the shaving head along the skin surface, wherein the control circuitry is arranged to alternately: control the power source to provide electric power to the elongate heating element responsive to the detected motion along the skin surface being in excess of a predetermined minimum rate of motion; and otherwise control the power source to not provide electric power to the elongate heating element.

In one further embodiment the hair shaving apparatus further comprises: a controllable lift mechanism, the heating element coupled to the controllable lift mechanism; and a motor in communication with the controllable lift mechanism, the controllable lift mechanism arranged to translate the heating element towards the opening plane responsive to the motor, wherein the translation of the heating element causes the heating element to apply a fixed pressure to the skin surface.

The embodiments herein independently enable a method of shaving hair, the method comprising: providing electric power to a heating element, the provided electric power arranged to heat the heating element to a temperature sufficient to cut hair proceeding from a skin surface, the heating element positioned in between opposing walls of a shaving head and juxtaposed to an opening plane defined by an end of each of the opposing walls, the shaving head coupled to a handle, the handle exhibiting a longitudinal axis, the longitudinal axis arranged to present a device angle between the longitudinal axis and the skin surface; positioning the opening plane generally parallel to the skin surface; rotating the opening plane about a first rotation axis, the first rotation axis generally parallel to the opening plane; and rotating the opening plane about a second rotation axis, the second rotation axis generally parallel to the opening plane and generally orthogonal to the first rotation axis, wherein the rotation about the first rotation axis and the second rotation axis maintains the generally parallel relationship between the opening plane and the skin surface when the device angle changes.

In one further embodiment the shaving head is coupled to a shaving head rotational base, the shaving head rotational base coupled to the handle, wherein the rotating about the second rotation axis comprises rotating the shaving head rotational base about the second rotation axis. In one yet further embodiment the shaving head comprises a shaving head extender, the shaving head rotational base comprises a base rotation extender and a head rotation guide, and the handle comprises a base rotation guide, wherein the rotating about the first rotation axis comprises sliding the shaving head extender along the head rotation guide, and wherein the rotating about the second rotation axis comprises sliding the base rotation extender along the base rotation guide.

In one further embodiment the rotating about the first rotation axis is by about 30 degrees. In another further embodiment the rotating about the second rotation axis is by about 30 degrees.

In one further embodiment the shaving head comprises a pair of rollers, each coupled to an end of a respective one of the opposing walls, the pair of rollers defining the opening plane and arranged to be in contact with the skin surface, and wherein the maintenance of the generally parallel relationship between the opening plane and the skin surface comprises maintaining both of the rollers in contact with the skin surface. In another further embodiment the method further comprises: detecting motion of the shaving head along the skin surface; providing electric power to the heating element responsive to the detected motion along the skin surface being in excess of a predetermined minimum rate of motion; and not providing electric power to the heating element responsive to the detected motion along the skin surface not being in excess of the predetermined minimum rate of motion.

In one further embodiment the method further comprises translating the heating element towards the opening plane such that the heating element applies a fixed pressure to the skin surface.

Additional features and advantages will become apparent from the following drawings and description.

BRIEF DESCRIPTION OF THE DRAWINGS

For a better understanding of the invention and to show how the same may be carried into effect, reference will now be made, purely by way of example, to the accompanying drawings in which like numerals designate corresponding elements or sections throughout.

With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice. In the accompanying drawings.

DETAILED DESCRIPTION OF THE PREFERRED EMBODIMENTS

Figure 1A:
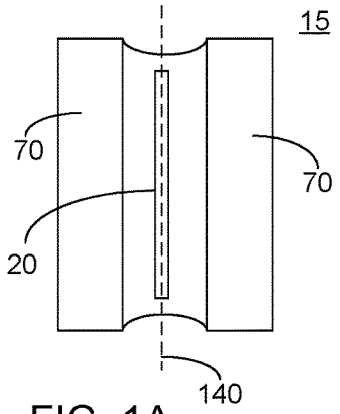
FIGS. 1A-1K illustrate various high level views of a heated element based shaver, according to certain embodiments.

Before explaining at least one embodiment of the invention in detail, it is to be understood that the invention is not limited in its application to the details of construction and the arrangement of the components set forth in the following description or illustrated in the drawings. The invention is applicable to other embodiments or of being practiced or carried out in various ways. Also, it is to be understood that the phraseology and terminology employed herein is for the purpose of description and should not be regarded as limiting.

Figure 1B:
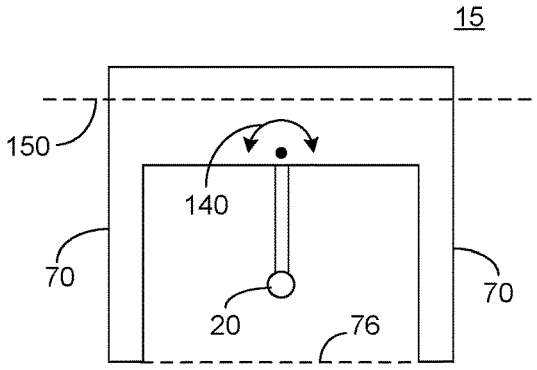
Figure 1C:
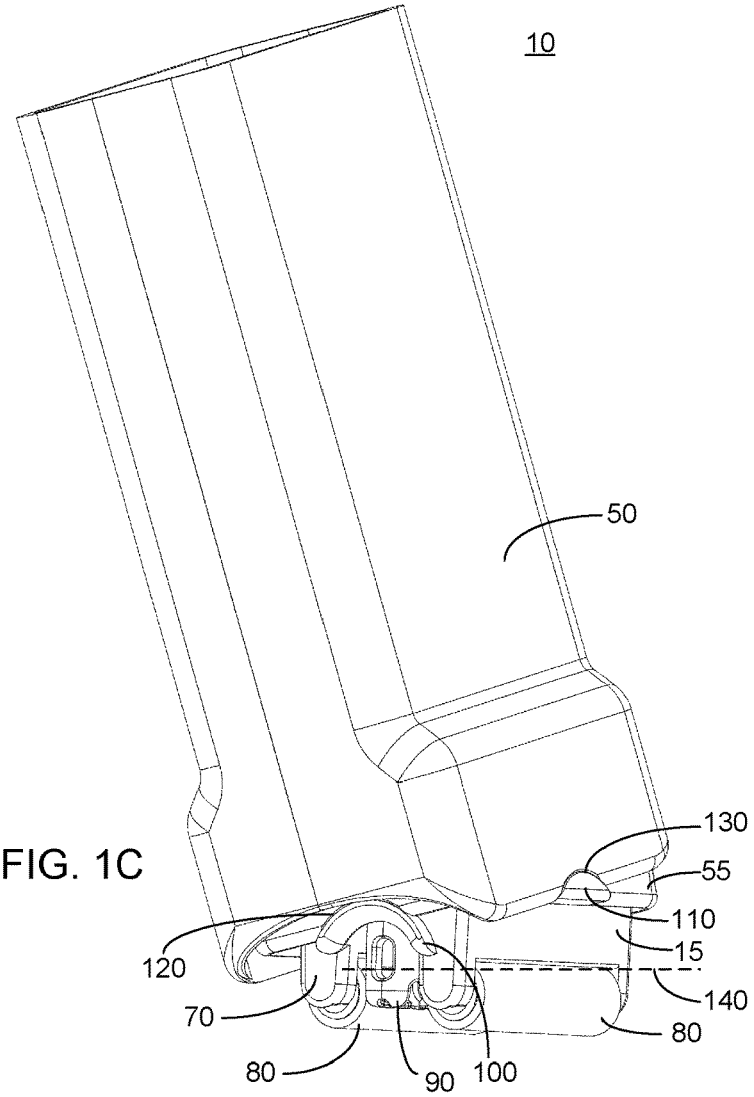
Figure 1D:
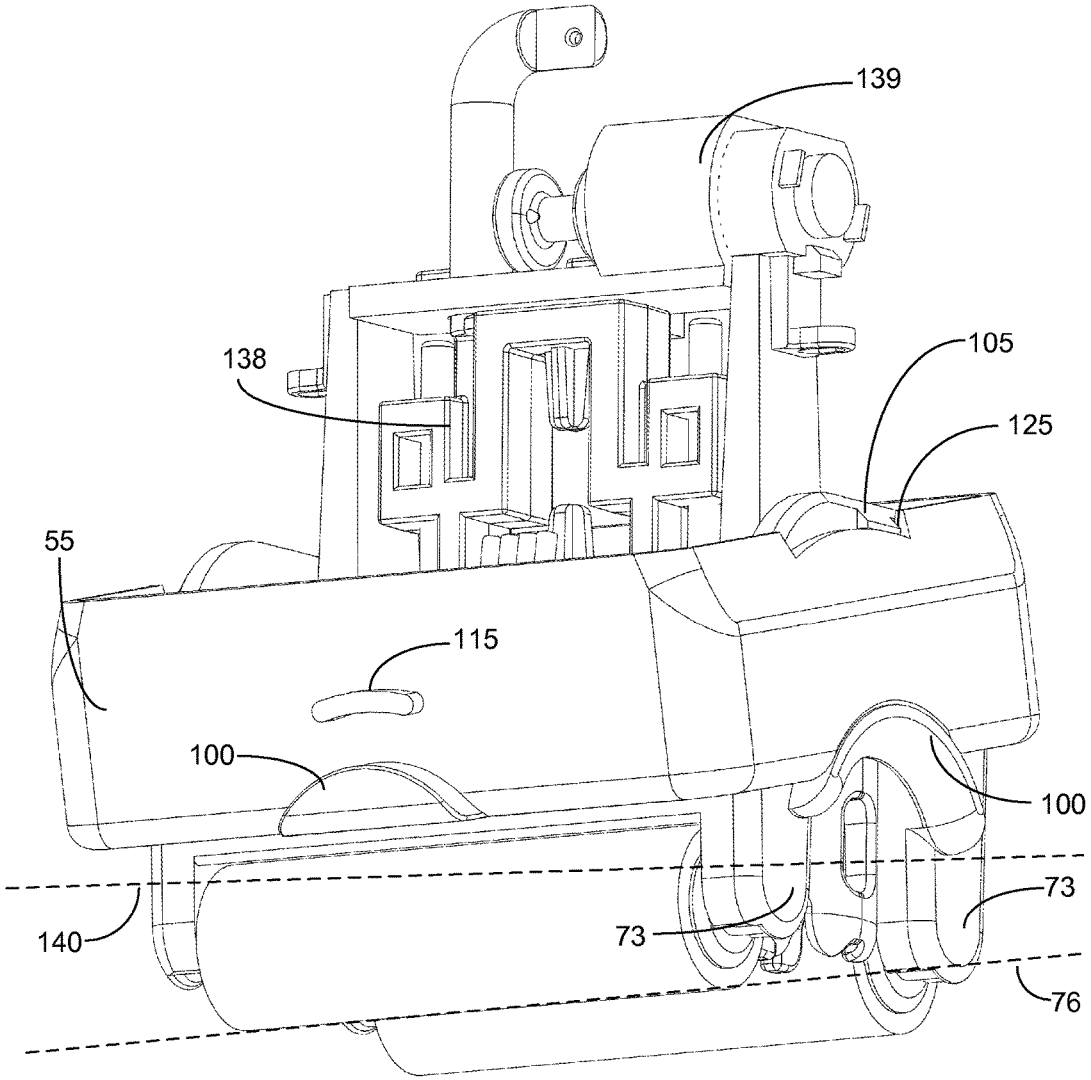
Figure 1E:
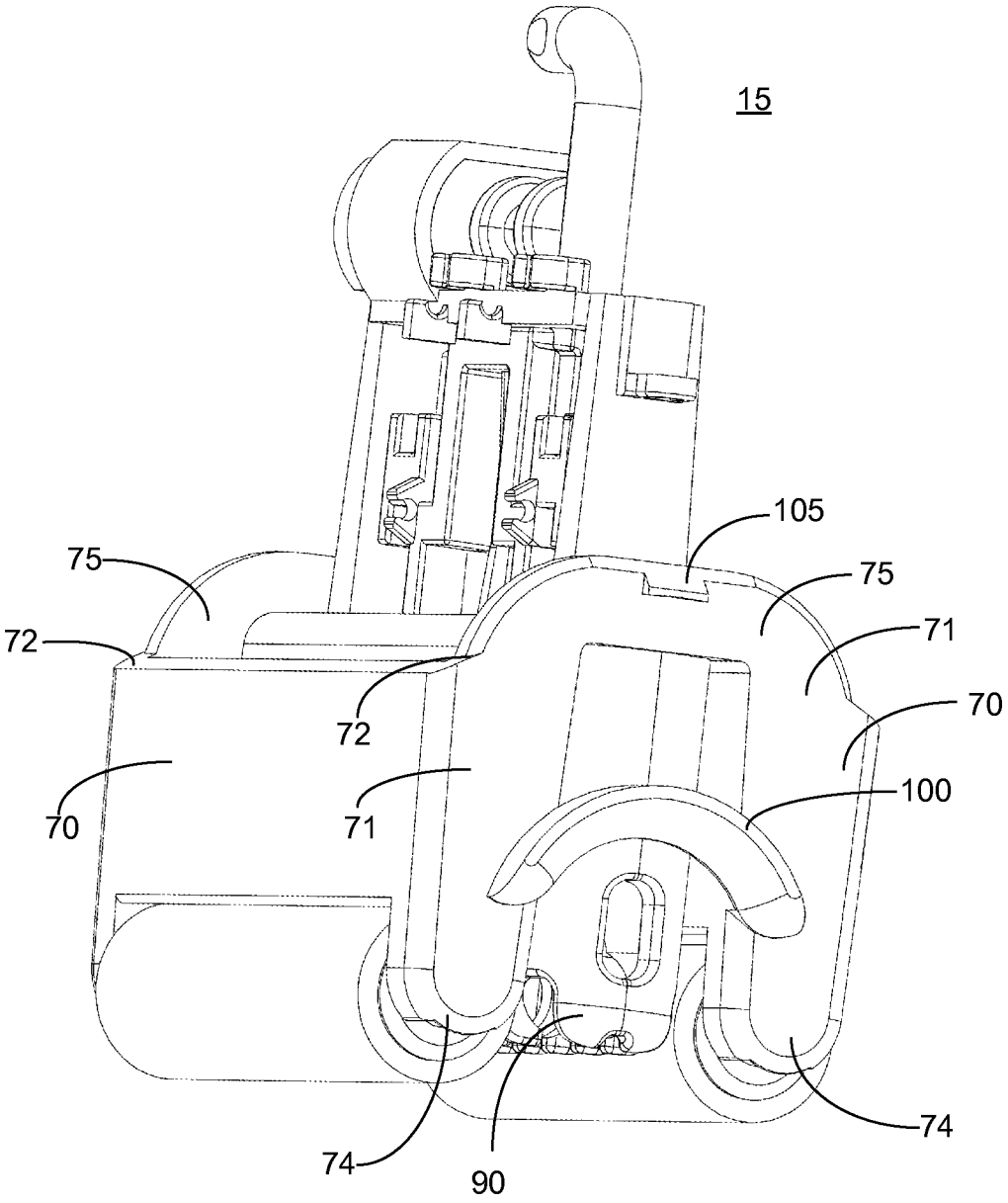
Figure 1F:
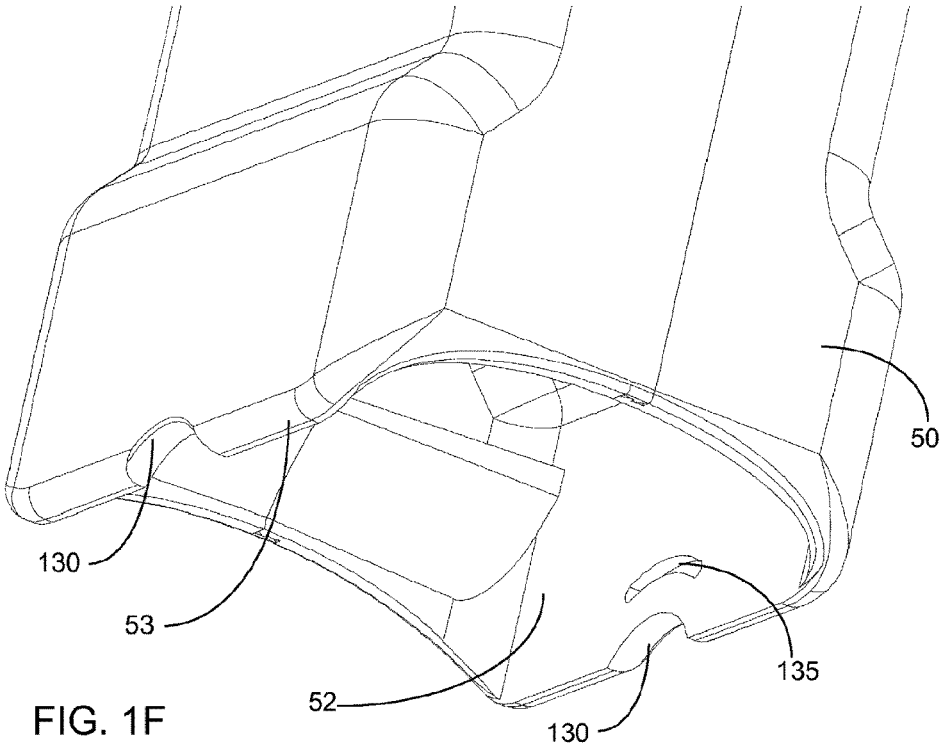
Figure 1G:
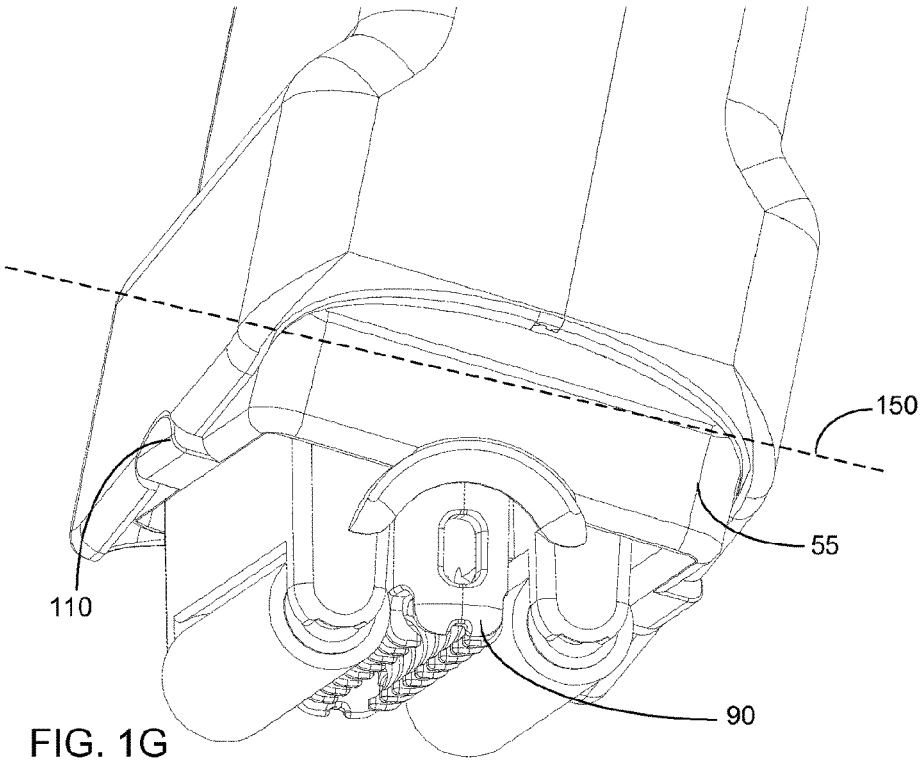
Figure 1H:
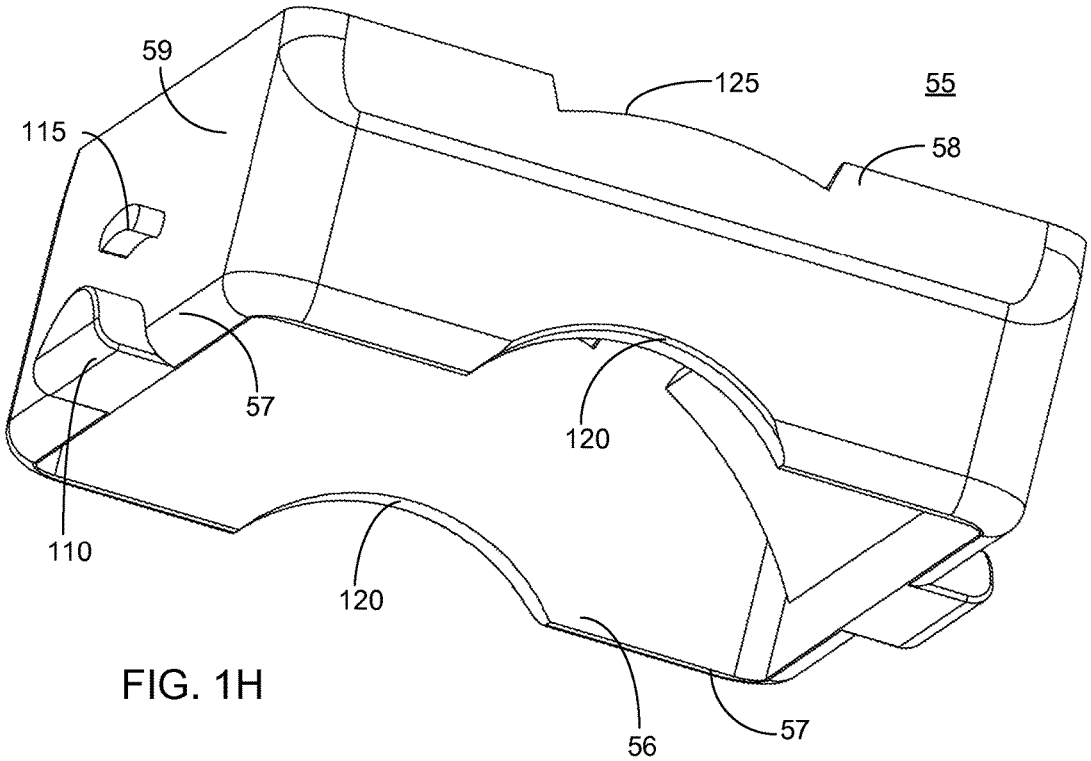
Figure 1I:
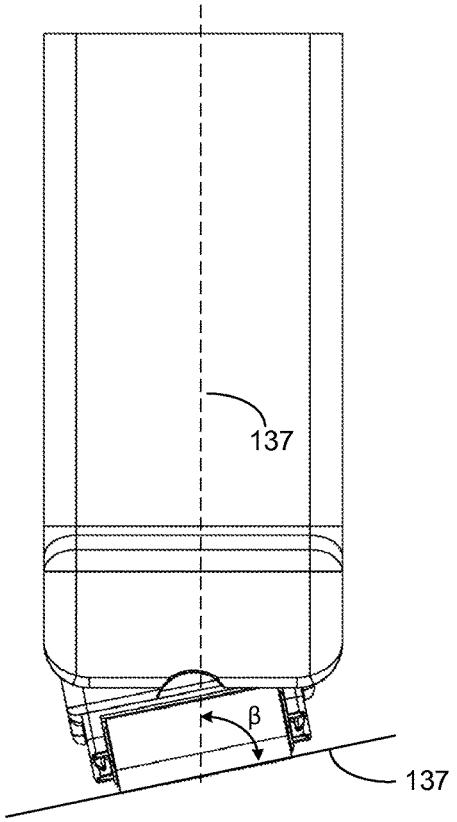
Figure 1J:
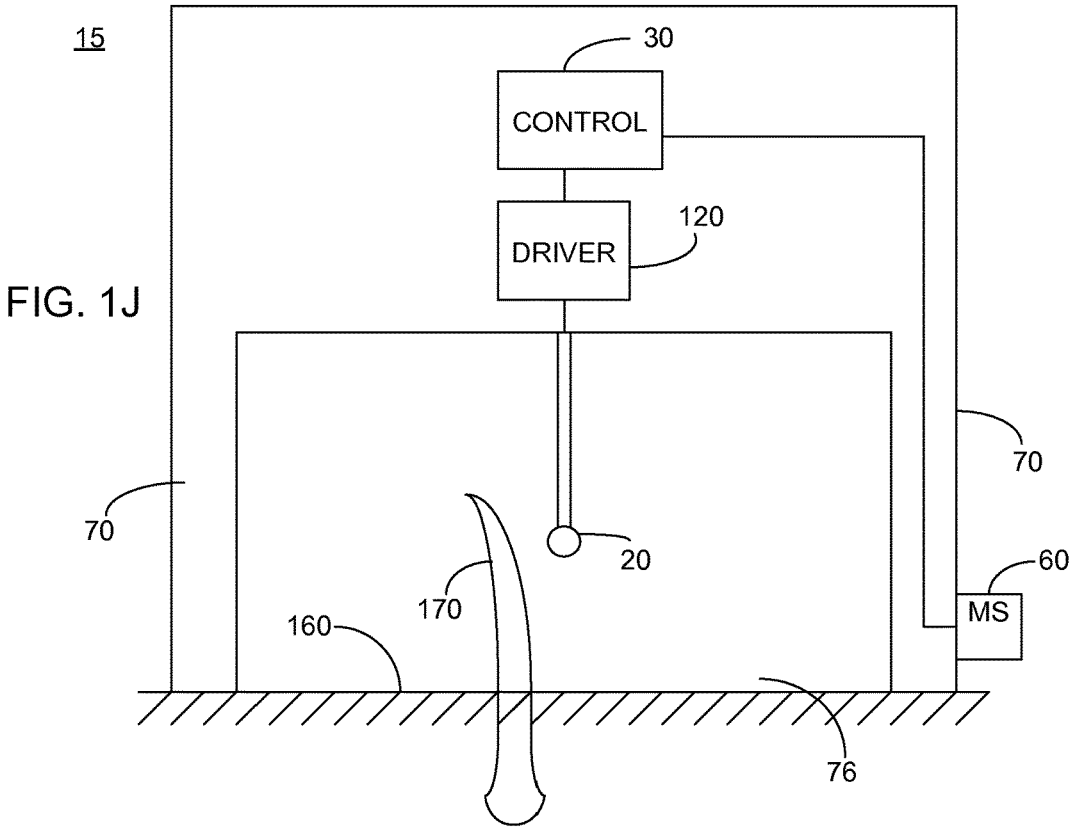
Figure 1K:
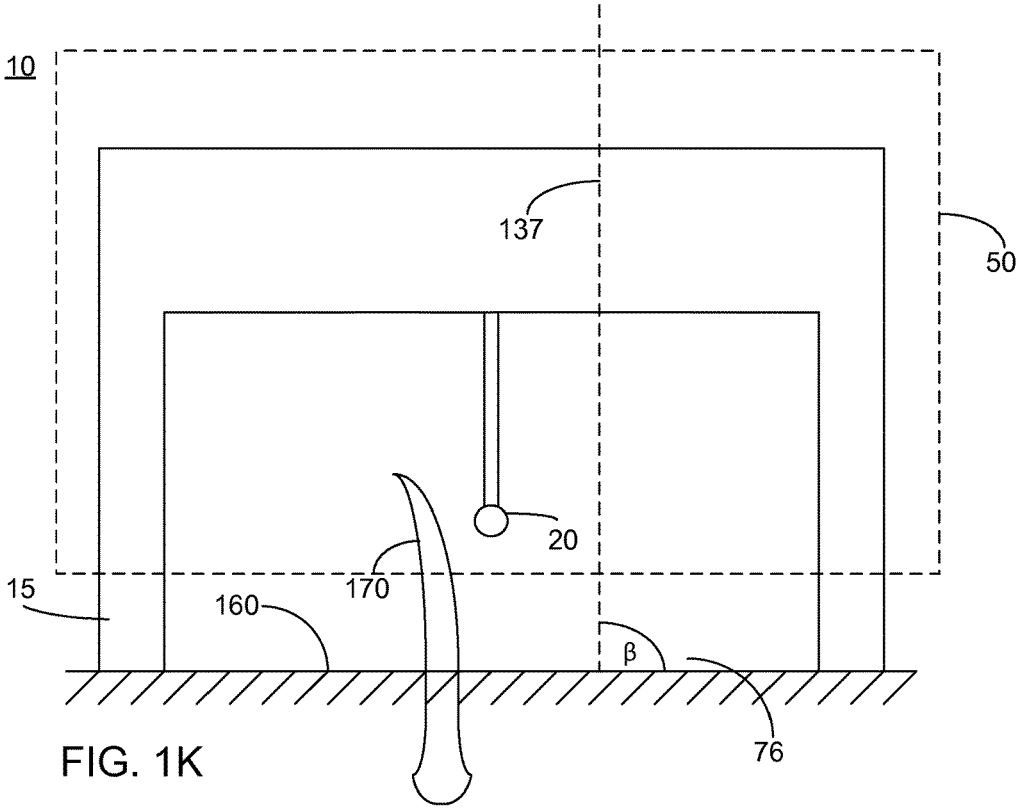
Figure 2:
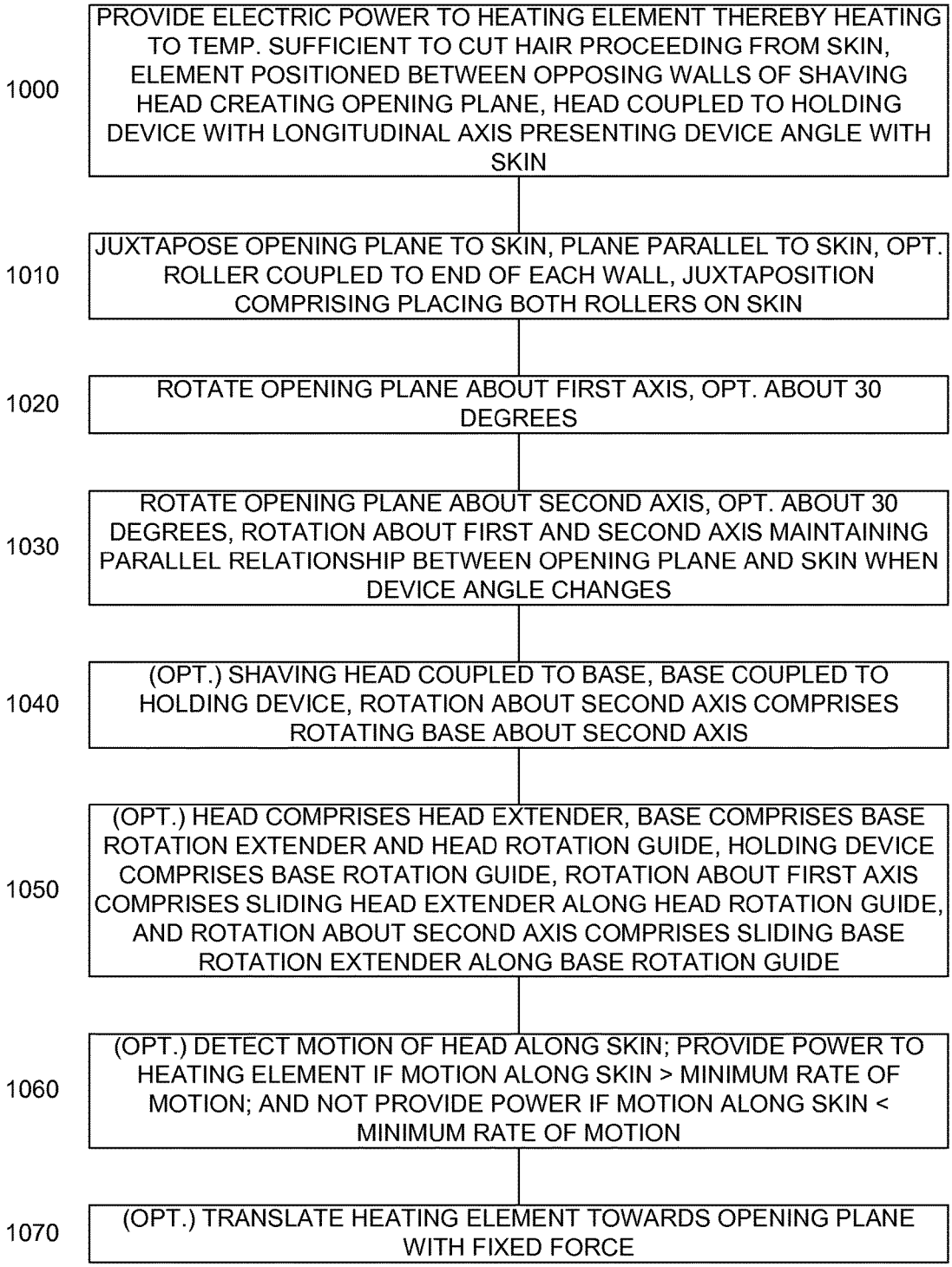
FIG. 2 illustrates a high level flow chart of a method of shaving hair, according to certain embodiments.

FIG. 1A illustrates a high level bottom view of a shaver head 15 of heated element based shaver 10; FIG. 1B illustrates a high level side view of shaver head 15; FIG. 1C illustrates a high level perspective view of heated element based shaver 10; FIG. 1D illustrates a high level perspective view of various parts of heated element based shaver 10; FIG. 1E illustrates a high level perspective view of shaver head 15; FIG. 1F illustrates a high level perspective view of a portion of a handle 50 of heated element based shaver 10; FIG. 1G illustrates a high level perspective view of a portion of heated element based shaver 10; FIG. 1H illustrates a high level perspective view of a shaving head rotational base 55 of heated element based shaver 10; FIG. 1I illustrates a high level side view of heated element based shaver 10; FIG. 1J illustrates a high level schematic diagram of the circuitry of shaving head 15; and FIG. 1K illustrates a high level side view of a portion of heated element based shaver 10, FIGS. 1A-1K being described together. Shaver 10 comprises:

shaving head 15; an elongate heating element 20; a control circuitry 30; a power source 40; a handle 50; a shaving head rotational base 55; a motion sensor 60. Shaving head 15 comprises: a pair of opposing walls 70; a pair of wall couplers 75; a pair of optional rollers 80; a plurality of optional skin depressors 90; a pair of lower shaving head rotation extenders 100; and a pair of upper shaving head rotation extenders 105. Shaving head rotational base 55 exhibits: a pair of lower base rotation extenders 110; a pair of upper base rotation extenders 115; a pair of lower head rotation guides 120; and a pair of upper head rotation guides 125. Handle 50 exhibits: a pair of lower base rotation guides 130; a pair of upper base rotation guides 135; and a longitudinal axis 137.

In one embodiment, handle 50 is hollow square shaped, exhibiting an opening 52 at an end 53 thereof. In one embodiment, each lower base rotation guide 130 is a semi-circle shape indentation within end 53 of handle 50 and each upper base rotation guide 135 is a semi-circle shape slit within handle 50. Each upper base rotation guide 135 is positioned along handle 50 away from a respective lower base rotation guide 130. In another embodiment, lower base rotation guides 130 are each positioned on opposing sides of handle 50. Handle 50 is preferably arranged to be comfortably held by the user of heated element based shaver 10.

Shaving head rotational base 55 is in one embodiment hollow square shaped, exhibiting an opening 56 at an end 57 thereof. In one embodiment, lower head rotation guides 120 are semi-circle shape indentations within end 57 of shaving head rotational base 55. In another embodiment, lower head rotation guides 120 are situated within opposing sides of shaving head rotational base 55. In one embodiment, each upper head rotation guide 125 is a semi-circle indentation within an end 58 of shaving head rotational base 55, end 58 opposing end 57. Each upper head rotation guide 125 is situated on the same side as a respective lower head rotation guide 120.

In one embodiment, lower base rotation extenders 110 are semi-circle shape extensions extending from end 57 of a side 59 of shaving head rotational base 55. In another embodiment, lower base rotation extenders 110 are situated within opposing sides 59 of shaving head rotational base 55, different than the sides 59 comprising lower head rotation guides 120. In one embodiment, each upper base rotation extender 115 is a semi-circle extension extending from the side 59 comprising a respective lower base rotation extender 115, each upper base rotation extender 115 displaced from lower base rotation extender 110 in the direction of end 58.

Walls 70 of shaving head 15 each extend from a first end 72 to an opposing second end 74, second ends 74 defining an opening plane 76. Wall couplers 75 couple walls 70 at first ends 72 thereof. Each optional roller 80 is coupled to second 74 of a respective wall 70. In the embodiment where optional rollers 80 are provided, opening plane 76 is defined by optional rollers 80. Optional skin depressors 90 extend to opening plane 76, between opposing walls 74 and are optionally coupled to wall couplers 75. In one embodiment, a first lower shaving head extender 100 and a first upper shaving head extender 105 each extend from a first side 71 of each wall 70, each first lower shaving extender 100 and first upper shaving head extender 105 stretching across the opening between walls 70. First upper shaving head extender 105 is displaced from first lower shaving head extender 100, away from opening plane 76. A second lower shaving head extender 100 and a second upper shaving head extender 105 each extend from a second side 73 of each wall 70, each second lower shaving extender 100 and second upper shaving head extender 105 stretching across the opening between walls 70. Second upper shaving head extender 105 is displaced from second lower shaving head extender 100, away from opening plane 76. In another embodiment, each lower shaving head rotation extender 100 is a semi-circle shape extension.

Optional skin depressors 90 are situated between walls 70 and extend to opening plane 76 and elongate heating element 20 is situated between optional skin depressors 90. In one embodiment, a controllable lift mechanism 138 is provided. Controllable lift mechanism 138 is arranged to translate elongate heating element 20 towards and away from opening plane 76, responsive to a motor 139, as described in International Patent Application Publication WO 2013/011505 published on Jan. 24, 2013 to RADIANCY INC., et al, the entire contents of which are incorporated herein by reference. In particular, motor 139 is arranged to control the translation of controllable lift mechanism. In one embodiment, motor 139 rotates a cam exhibiting a shortened radius portion and an extended radius portion, the cam in mechanical communication with elongate heating element 20. When the extended radius portion faces opening plane 76, elongate heating element 20 is translated towards opening plane 76. When the shortened radius portion faces opening plane 76, elongate heating element 20 is translated away from opening plane 76. In another embodiment, controllable lift mechanism 138 comprises a mechanical cradle. In another embodiment, controllable lift mechanism 138 comprises a swinging lever arranged for alternate rectilinear motion. Motor 139 causes elongate heating element 20 to be translated towards opening plane 76 exhibiting a constant force.

Shaving head 15 is situated within shaving head rotational base 55. Each lower shaving head rotation extender 100 is positioned within a respective lower head rotation guide 120 of shaving head rotational base 55 and each upper shaving head rotation extender 105 is positioned within a respective upper head rotation guide 125. Lower shaving head rotation extenders 100, upper shaving head rotation extenders 105, lower head rotation guides 120 and upper head rotation guides 125 are positioned such that shaving head 15 is rotatable about a rotation axis 140, rotation axis 140 being generally parallel to opening plane 76. In particular, the rotation about rotation axis 140 is achieved as lower and upper shaving head rotation extenders 100 and 105 slide within the respective lower and upper rotation guides 120 and 125. In one embodiment, shaving head is rotatable by 30 degrees about rotation axis 140.

Shaving head rotational base 55 is situated within handle 50. Each lower base rotation extender 110 is positioned within a respective lower base rotation guide 130 of handle 50 and each upper base rotation extender 115 is positioned within a respective upper base rotation guide 135 of handle 50. Lower base rotation extenders 110, upper base rotation extenders 115, lower base rotation guides 130 and upper base rotation guides 135 are positioned such that shaving head rotational base 55 is rotatable about a rotation axis 150, rotation axis 150 being generally parallel to opening plane 76 and generally orthogonal to rotation axis 140. In particular, the rotation about rotation axis 150 is achieved as lower and upper base rotation extenders 110 and 115 slide within the respective lower and upper rotation guides 130 and 135. In one embodiment, shaving head rotational base 55 is rotatable by 30 degrees about rotation axis 150.

In one embodiment, elongate heating element 20 comprises a Nickel Chromium alloy. In one further embodiment, elongate heating element 20 comprises Nichrome. In another embodiment, elongate heating element 20 comprises a Molybdenum disilicide alloy. In another embodiment, elongate heating element 20 comprises a ferritic iron-chromium-aluminum alloy.

In one embodiment, elongate heating element 20 is elongate rectangular cuboid shaped. In one further embodiment, elongate heating element 20 presents a rectangular cross-section having a length to width ratio of 2-8, optionally a length to width ratio of about 5. In one embodiment, the width of the cross section of elongate heating element 20 presents a width of 0.06-1 mm, optionally a width of about 0.08 mm. The length of elongate heating element 20 is in one embodiment constructed to extend from one end to another of opening 55.

In one embodiment, power source 40 is a rechargeable power source. In one embodiment, motion sensor 60 comprises any of a plurality of standard motion sensors including, but not limited to: an optical sensor; a magnetic sensor; a mechanical sensor; and an ultrasonic sensor. In one particular embodiment, motion sensor 60 comprises a roller arranged to come in contact with a skin surface 160. Control circuitry 30 is arranged to calculate the rate of relative motion of shaving head 15 along skin surface 160 responsive to motion sensor 60.

Elongate heating element 20 is arranged to be heated to a temperature sufficient to cut hair 170 protruding from skin surface 160, responsive to an appropriate current flowing there through, optionally 400°-1900° C., further optionally 1000°-1900° C. In one embodiment, a thermal sensor is provided (not shown) in communication with elongate heating element 20, the output of the thermal sensor provided as a feedback to control circuitry 30. In such an embodiment, control circuitry 30 is arranged to maintain supervisory control of the temperature of elongate heating element 20 and prevent the temperature of elongate heating element 20 from exceeding a predetermined maximum, and optionally further ensure that the temperature of elongate heating element 20 does not fall below a predetermined minimum during operation.

In operation, opening plane 76 of shaving head 15 is juxtaposed with skin surface 160 by a user grasping handle 50. Shaving head 15 is then glided over skin surface 160. Control circuitry 30 is arranged to control power source 40 to provide a current to elongate heating element 20, thereby heating elongate heating element 20. The heat generated by elongate heating element 20 singes one or more hair shafts 170, thereby removing the hair. Additionally, the hair follicles are damaged by the output heat thereby suppressing future hair growth. In one embodiment, elongate heating element 20 is pulsed and skin surface 160 is thus alternately heated and cooled thereby preventing burning thereof. In another embodiment, in the event that motion sensor 60 detects that the rate of relative motion of shaving head 15 along skin surface 160 is less than a predetermined minimum threshold, control circuitry 30 is arranged to cease heating of elongate heating element 20. In one embodiment, the temperature of the heat output by elongate heating element 20 is responsive to the detected rate of relative motion of shaving head 15 along skin surface 160, the temperature being increased as the rate of relative motion increases and decreased as the rate of relative motion decreases. In the embodiment where optional skin depressors 90 are provided, optional skin depressors 90 depress skin surface 160 thus providing increased exposure of the hair 170 to the heat output by elongate heating element 20.

As opening plane 76 is juxtaposed with skin surface 160, longitudinal axis 137 exhibits a device angle with skin surface 160, the device angle denoted β. When opening plane 76 is parallel to skin surface 160, device angle β may move according to the movement of the user's hand. As described above, shaving head rotational base 55 is rotatable about rotation axis 150 and shaving head 15 is rotatable about rotation axis 140, rotation axes 140 and 150 being generally orthogonal to each other and parallel to opening plane 76. Therefore, opening plane 76 is rotatable about two orthogonal rotation axes 140 and 150, as the rotation of shaving head rotational base 55 about rotation axis 150 causes the rotation of shaving head 15 about rotation axis 150, since shaving head 15 is mechanically coupled to shaving head rotational base 55. As a result, opening plane 76 will maintain its parallel relationship with skin surface 160, regardless of the change in device angle β. In addition, when shaving head 15 is glided over a body part where the angle of skin surface 160 changes, opening plane 76 will maintain its parallel relationship with skin surface 160 regardless of the change in device angle β.

As described above, in the embodiment where optional rollers 80 are provided opening plane 76 is defined by optional rollers 80. Thus, maintaining a parallel relationship between opening plane 76 and skin surface 160 entails maintaining both optional rollers 80 in contact with skin surface 160. As described above, the rotation of opening plane 76 about rotation axes 140 and 150 allow optional rollers 80 to maintain contact with skin surface 160 regardless of the change in device angle β.

As described above, in one embodiment elongate heating element 20 is translated towards and away from opening plane 76 responsive to motor 139. Advantageously, the force applied by motor 139 is fixed. Thus, in the event that shaving head 15 is pressed against skin surface 160 and as a result a portion of skin surface 160 enters in between skin depressors 90 and comes in contact with elongate heating element 20, the pressure applied by elongate heating element 20 to skin surface 160 is fixed. In one embodiment, the pressure applied by elongate heating element 20 is about 1 gr/mm$^2$.

FIG. 4 illustrates a high level flow chart of a method of shaving hair, according to certain embodiments. In stage 1000, electric power is provided to an elongate heating element to thereby heat the elongate heating element to a temperature sufficient to cut hair proceeding from a skin surface. Optionally, the elongate heating element presents a rectangular cross-section with a length to width ratio of 2-8, optionally 5. Optionally the rectangular cross-section exhibits a width of 0.06-0.1 mm, optionally 0.08 mm.

The elongate heating element is positioned in between opposing walls of a shaving head and juxtaposed to an opening plane defined by an end of each of the opposing walls. The shaving head is coupled to a handle, the handle exhibiting a longitudinal axis. The longitudinal axis is arranged to present a device angle between the longitudinal axis and a skin surface.

In stage 1010, the opening plane of stage 1000 is juxtaposed to the skin surface such that the opening plane is generally parallel with the skin surface. The juxtaposition of the opening plane to the skin surface causes a juxtaposition of the elongate heating element to the skin surface. Optionally, a roller is coupled to the end of each opposing wall of stage 1000, the juxtaposition of the opening plane to the skin surface comprises placing both rollers on the skin surface.

In stage 1020, the opening plane of stage 1000 is rotated about a first rotation axis. The first rotation axis is generally parallel to the opening plane. Optionally, the rotation about the first rotation axis is to about 30 degrees.

In stage 1030, the opening plane of stage 1000 is rotated about a second rotation axis. The second rotation axis is generally parallel to the opening plane and is generally orthogonal to the first rotation axis of stage 1020. As described above, the rotation of the opening plane about the first rotation axis and the second rotation axis maintains the generally parallel relationship between the opening plane and the skin surface when the device angle of stage 1000 changes, i.e. the generally parallel relationship between the opening plane and the skin surface is maintained regardless of the change in the device angle.

In optional stage 1040, the shaving head of stage 1000 is coupled to a shaving head rotational base, the shaving head rotational base coupled to the handle of stage 1000. The rotation about the second rotation axis comprises rotating the shaving head rotational base about the second rotation axis. Further optionally, in optional stage 1050: the shaving head comprises at least one shaving head extender; the shaving head rotational base comprises at least one base rotation extender and at least one head rotation guide; and the handle comprises at least one base rotation guide. Each shaving head extender is arranged to be situated within a respective head rotation guide. Each base rotation extender is arranged to be situated within a respective base rotation guide. The rotation of the opening plane about the first rotation axis comprises sliding the at least one shaving head extender along the respective head rotation guides. The rotation of the opening plane about the second rotation axis comprises sliding the at least one base rotation extender along the respective base rotation guides. In the embodiment where a roller is provided at the end of each wall of stage 1000, the maintenance of the generally parallel relationship between the opening plane and the skin surface comprises maintaining both of the rollers in contact with the skin surface.

In optional stage 1060, a motion sensor is arranged to detect motion of the shaving head of stage 1000 along the skin surface. Electric power is provided to the elongate heating element of stage 1000 responsive to the detected motion of the shaving head along the skin surface being in excess of a predetermined minimum rate of motion. In the event that the detected motion of the shaving head along the skin surface is not in excess of the predetermined minimum rate of motion, electric power is not provided to the elongate heating element, thereby ceasing heat output by the elongate heating element.

In optional stage 1070, the heating element of stage 1000 applies a fixed pressure if it comes in contact with the skin surface. Optionally, the fixed pressure is about 1 gr/mm$^2$. The fixed pressure is achieved by translating the heating element towards the opening plane with a fixed force. In one embodiment, a controllable lift mechanism is controlled by a motor to periodically translate the heating element towards and away from the opening plan. The controllable lift mechanism optionally comprises one of: a cam; a mechanical cradle; and a swinging lever arranged for alternate rectilinear motion.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination. In the claims of this application and in the description of the invention, except where the context requires otherwise due to express language or necessary implication, the word "comprise" or variations such as "comprises" or "comprising" is used in any inclusive sense, i.e. to specify the presence of the stated features but not to preclude the presence or addition of further features in various embodiments of the invention.

Unless otherwise defined, all technical and scientific terms used herein have the same meanings as are commonly understood by one of ordinary skill in the art to which this invention belongs. Although methods similar or equivalent to those described herein can be used in the practice or testing of the present invention, suitable methods are described herein.

All publications, patent applications, patents, and other references mentioned herein are incorporated by reference in their entirety. In case of conflict, the patent specification, including definitions, will prevail. In addition, the materials, methods, and examples are illustrative only and not intended to be limiting. No admission is made that any reference constitutes prior art. The discussion of the reference states what their author's assert, and the applicants reserve the right to challenge the accuracy and pertinency of the cited documents. It will be clearly understood that, although a number of prior art complications are referred to herein, this reference does not constitute an admission that any of these documents forms part of the common general knowledge in the art in any country.

It will be appreciated by persons skilled in the art that the present invention is not limited to what has been particularly shown and described hereinabove. Rather the scope of the present invention is defined by the appended claims and includes both combinations and sub-combinations of the various features described hereinabove as well as variations and modifications thereof, which would occur to persons skilled in the art upon reading the foregoing description.

The invention claimed is:

1. A method of shaving hair, the method comprising:

providing electric power to a heating element, said provided electric power arranged to heat the heating element to a temperature sufficient to cut hair proceeding from a skin surface, the heating element positioned in between opposing walls of a shaving head and juxtaposed to an opening plane defined by an end of each of the opposing walls, the shaving head coupled to a handle, the handle exhibiting a longitudinal axis, the longitudinal axis arranged to present a device angle between the longitudinal axis and the skin surface;

positioning the opening plane generally parallel to the skin surface;

rotating the opening plane about a first rotation axis, the first rotation axis generally parallel to the opening plane; and rotating the opening plane about a second rotation axis, the second rotation axis generally parallel to the opening plane and generally orthogonal to the first rotation axis, wherein said rotation about said first rotation axis and said second rotation axis maintains the generally parallel relationship between the opening plane and the skin surface when the device angle changes, wherein the shaving head is coupled to a shaving head rotational base, the shaving head rotational base coupled to the handle, wherein said rotating about said second rotation axis comprises rotating the shaving head rotational base about the second rotation axis, wherein the shaving head comprises a shaving head extender, the shaving head rotational base comprises a base rotation extender and a head rotation guide, and the handle comprises a base rotation guide, wherein said rotating about the first rotation axis comprises sliding the shaving head extender along the head rotation guide, and wherein said rotating about the second rotation axis comprises sliding the base rotation extender along the base rotation guide.

2. The method of claim 1, wherein said rotating about the first rotation axis is by about 30 degrees.

3. The method of claim 1, wherein said rotating about the second rotation axis is by about 30 degrees.

4. The method of claim 1, further comprising:

detecting motion of the shaving head along the skin surface;

providing electric power to the heating element responsive to said detected motion along the skin surface being in excess of a predetermined minimum rate of motion; and not providing electric power to the heating element responsive to said detected motion along the skin surface not being in excess of said predetermined minimum rate of motion.

5. The method of claim 1, further comprising translating the heating element towards the opening plane such that the heating element applies a fixed pressure to the skin surface.

6. A hair shaving apparatus comprising:

a power source;

a heating element, said heating element arranged to be heated to a temperature sufficient to cut hair proceeding from a skin surface, said heating element heated with electric power from said power source;

a shaving head exhibiting a pair of opposing walls, said heating element positioned in between said opposing walls and juxtaposed to an opening plane defined by an end of each of said opposing walls, said opening plane arranged to be generally parallel to the skin surface;

a handle, said handle coupled to said shaving head and exhibiting a longitudinal axis, said longitudinal axis arranged to present a device angle between said longitudinal axis and the skin surface; and a shaving head rotational base, said shaving head rotational base coupled to said handle and to said shaving head, wherein said opening plane is arranged to be rotated about a first rotation axis and a second rotation axis, said first rotation axis and said second rotation axis generally orthogonal to each other and generally parallel to said opening plane, said rotation about said first rotation axis and said second rotation axis maintaining the generally parallel relationship between said opening plane and the skin surface when said device angle changes, wherein said arrangement of said opening plane to be rotated about said second rotation axis comprises a rotation of said shaving head rotational base about said second rotation axis, wherein said shaving head comprises a shaving head extender, said shaving head rotational base comprises a base rotation extender and a head rotation guide, and said handle comprises a base rotation guide, wherein said rotation about said first rotation axis comprises sliding said shaving head extender along said head rotation guide, and wherein said rotation about said second rotation axis comprises sliding said base rotation extender along said base rotation guide.

7. The hair shaving apparatus of claim 6, wherein said shaving head is arranged to be rotated about said first rotation axis by about 30 degrees.

8. The hair shaving apparatus of claim 6, wherein said shaving head is arranged to be rotated about said second rotation axis by about 30 degrees.

9. The hair shaving apparatus of claim 6, wherein said shaving head comprises a pair of rollers, each coupled to an end of a respective one of said opposing walls, said pair of rollers defining said opening plane and arranged to be in contact with the skin surface, and wherein said maintenance of the generally parallel relationship between said opening plane and the skin surface comprises maintaining both of said rollers in contact with the skin surface.

10. The hair shaving apparatus of claim 6, further comprising:

a control circuitry; and a motion sensor in communication with said control circuitry and arranged to detect motion of said shaving head along the skin surface, wherein said control circuitry is arranged to alternately:

control said power source to provide electric power to said elongate heating element responsive to said detected motion along the skin surface being in excess of a predetermined minimum rate of motion; and otherwise control said power source to not provide electric power to said elongate heating element.

11. The hair shaving apparatus of claim 6, further comprising:

a controllable lift mechanism, said heating element coupled to said controllable lift mechanism; and a motor in communication with said controllable lift mechanism, said controllable lift mechanism arranged to translate said heating element towards said opening plane responsive to said motor, wherein said translation of said heating element causes said heating element to apply a fixed pressure to the skin surface.

12. A hair shaving apparatus comprising:

a power source;

a heating element, said heating element arranged to be heated to a temperature sufficient to cut hair proceeding from a skin surface, said heating element heated with electric power from said power source;

a shaving head exhibiting a pair of opposing walls and comprising a pair of rollers, each of said pair of rollers coupled to an end of a respective one of said opposing walls, said heating element positioned in between said opposing walls and juxtaposed to an opening plane defined by said pair of rollers, said opening plane arranged to be generally parallel to the skin surface and said pair of rollers arranged to be in contact with the skin surface;

a handle, said handle coupled to said shaving head and exhibiting a longitudinal axis, said longitudinal axis arranged to present a device angle between said longitudinal axis and the skin surface; and a shaving head rotational base, said shaving head rotational base coupled to said handle and to said shaving head, wherein said opening plane is arranged to be rotated about a first rotation axis and a second rotation axis, said first rotation axis and said second rotation axis generally orthogonal to each other and generally parallel to said opening plane, said rotation about said first rotation axis and said second rotation axis maintaining both of said rollers in contact with the skin surface when said device angle changes, wherein said arrangement of said opening plane to be rotated about said second rotation axis comprises a rotation of said shaving head rotational base about said second rotation axis, wherein said shaving head comprises a shaving head extender, said shaving head rotational base comprises a base rotation extender and a head rotation guide, and said handle comprises a base rotation guide, wherein said rotation about said first rotation axis comprises sliding said shaving head extender along said head rotation guide, and wherein said rotation about said second rotation axis comprises sliding said base rotation extender along said base rotation guide.

* * * * *